United States Patent [19]

Smith et al.

[11] Patent Number: 4,586,708

[45] Date of Patent: May 6, 1986

[54] SPORTS RACKET STRINGS OF A SYNTHETIC THERMOPLASTIC POLYMERIC MATERIAL

[75] Inventors: Francis S. Smith; Bruce M. McIntosh, both of North Yorkshire; Nigel W. Hayman, Cheltenham; Scott Davidson, North Yorkshire, all of England

[73] Assignee: Imperial Chemical Industries PLC, London, England

[21] Appl. No.: 708,816

[22] Filed: Mar. 5, 1985

[30] Foreign Application Priority Data

Mar. 9, 1984 [GB] United Kingdom ..... 8406219
Feb. 22, 1985 [GB] United Kingdom ..... 8504564

[51] Int. Cl.[4] ..... A63B 49/00; D02G 3/00

[52] U.S. Cl. ..... 273/73 D; 428/373; 428/375; 428/377

[58] Field of Search ..... 428/364, 373, 374, 377, 428/375; 57/243; 273/73 R, 67 R

[56] References Cited

U.S. PATENT DOCUMENTS 3,920,658 11/1975 Benson ..... 428/375 X
3,956,240 5/1976 Dahl et al. ..... 260/47 C
4,016,714 4/1977 Crandall et al. ..... 428/375 X
4,306,410 12/1981 Nakamura et al. ..... 428/377 X
4,359,501 7/1982 DiTullio ..... 428/245
4,391,088 7/1983 Salsky et al. ..... 428/377 X

FOREIGN PATENT DOCUMENTS 57-191322 5/1983 Japan .

OTHER PUBLICATIONS

Stening et al., "A New High Performance Thermoplastic", ICI Plastics Division, Welwyn Garden City, Herts, England, pp. 935–937.

*Primary Examiner*—Lorraine T. Kendell
*Attorney, Agent, or Firm*—Cushman, Darby & Cushman

[57] ABSTRACT

A monofilament or multifilament sports racket string, of a thermoplastic aromatic polyetherketone and preferably polyetheretherketone, such string preferably having an elongation not exceeding 5% when a tensile stress of at least 100 Newtons/mm$^2$ is applied along the axis of the string and preferably having a dynamic stiffness, measured at a mean stress of 175 Newtons/mm$^2$, of not greater than 1.150 times the dynamic stiffness measured at a mean tensile stress of 80 Newtons/mm$^2$.

40 Claims, 2 Drawing Figures

SPORTS RACKET STRINGS OF A SYNTHETIC THERMOPLASTIC POLYMERIC MATERIAL

The present invention relates to sports racket strings which are formed of a synthetic thermoplastic polymeric material.

BACKGROUND OF THE INVENTION

Strings for tennis, squash and badminton rackets are required to have specific characteristics of resistance to pulling and to elongation under a brief constraint or under repeated constraints; in these latter conditions, they should rapidly and totally take up their initial length again; finally, they should have good properties of resistance to different condition of use, notably abrasion resistance, resistance to creasing or kinking, resistance to various atmospheric factors as well as to the various constraints to which they are subjected during their fitting to rackets etc.

Strings of animal gut have been used for a very long time on high quality tennis and other rackets and have proved wholly acceptable from the point of view of power, feel and playability, but unfortunately show a poor resistance to moisture which shortens their playing life when humid conditions prevail. The elastic return characteristics (rapid and total return to the initial length after a brief constraint or repeated constraints) of natural gut are, however, excellent.

Apart from nylon monofilament which has been used extensively since 1944, strings made from other thermoplastic polymeric materials are also known from the patent literature:

U.S. Pat. No. 4,300,343 is concerned with a synthetic gut prepared by collectively twisting a plurality of monofilaments of a thermoplastic resin at a temperature higher than the softening point of said resin, thereby producing a gut wherein the monofilaments in the central portion of the gut adhere to one another such that the independent shape of each monofilament cannot be distinguished and wherein the monofilaments at the periphery of the gut adhere to one another while maintaining their independent shape. The monofilaments in the gut are made from a fluorocarbon resin, particularly a vinylidene fluoride resin, a polyamide resin or a polyester resin.

British Pat. No. 1 578 599 is concerned with a racket string consisting of from 2 to 4 monofilaments of an oriented, synthetic thermoplastic polymer, more particularly nylon 66 or nylon 6, with each monofilament having a denier of 2,000 to 8,000 and at least two flattened sides, two of which are opposed to one another, throughout its length, said monofilaments having substantially no individual twist and being ply-twisted and bonded together throughout the length of the string with each said monofilament being bonded along a flattened side to at least one other of said monofilaments.

British Pat. No. 1 569 530 describes a sports racket string comprising a substantially circular cross-section core of one or more synthetic resin monofilaments and an outer helically wound wrapping of synthetic resin monofilaments, which may be the same as or different from the synthetic resin material of the core, the wrapping being formed from monofilaments of at least two different diameters arranged so that along the length of the string there are alternately portions of surface comprising smaller diameter monofilaments and raised portions of surface comprising at least one larger diameter monofilament. The monofilaments used may be of a polyester, such as polyethylene terephthalate, or a nylon.

U.S. Pat. No. 4,275,117 is concerned with a racket string resulting from the integration under heat of a combination of elongated strands of a first and a second thermoplastic material, said first thermoplastic material having a substantially higher melting point than said second thermoplastic material, said string having been integrated by the application of heat sufficient to melt said second material but not said first material, said string, prior to integration, having a compressed core consisting at least in part of said second material, and a braided sheath over said core comprising strands of both said first and second materials. Nylon 66 having a melting point of approximately 480° F. is given as an example of the higher melting point thermoplastic material and a nylon ter-polymer having a melting point of approximately 310° F. is given as an example of the lower melting point thermoplastic material.

U.S. Pat. No. 4,328,055 is concerned with a method of preparing a synthetic gut comprising melt spinning a thermoplastic resin, more particularly a polyvinylidene fluoride resin, polyamide resin or a polyester resin, into a plurality of monofilaments, collectively twisting the plurality of monofilaments while the monofilaments are maintained at a temperature higher than the softening point of the resin thereby obtaining a gut having a structure consisting of a melt adhered nuclear part and a spiral peripheral part of the melt-adhered monofilaments.

U.S. Pat. No. 4,391,088 is concerned with a sports racket string consisting of a natural gut core covered with a filamentary aramid and impregnated with a coating of a water-resistant, vapour-impermeable flexible adhesive polymeric resin which adheres the filamentary aramid to the gut core.

U.S. Pat. No. 4,084,399 is concerned with a synthetic gut made from carbon fibres optionally combined with organic and/or inorganic fibres.

British Pat. No. 1 587 931 is concerned with a twisted bundle of synthetic multifilament yarns which are adhered together by a thermosettable adhesive. The yarns may be of nylon, polyester or an aromatic polyamide.

DESCRIPTION OF THE INVENTION

Figure 1:
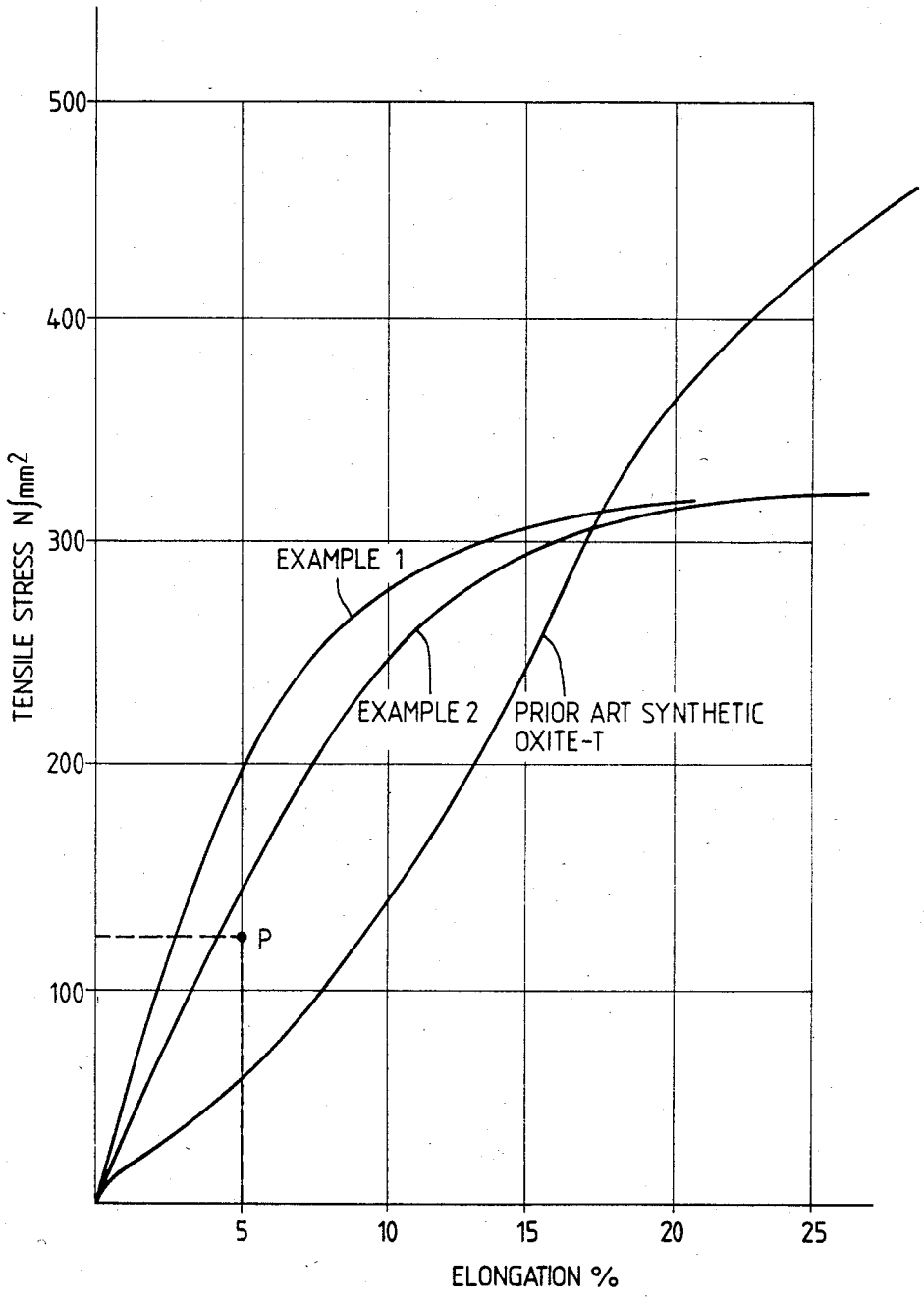
FIG. 1 is a graph showing load-elongation curves for several different sports racket strings.

The present invention may be understood in terms of the following theory, though it is not dependent on the correctness of the theory, and is not intended to be limited by it.

For a sports racket string to have good playing characteristics, it must possess several important properties. In order to obtain maximum power from the racket, the kinetic energy of the ball when it strikes the racket must be absorbed by the strings, and then returned to the ball with as little loss as possible. This demands that the elastic deformation of the racket strings must be completely recovered within the time that the ball is in contact with the strings, which is typically 5–7 milliseconds in the case of a tennis ball and racket. Rapid and total return of the strings is achieved only if the string material shows low hysteresis loss, and also has a high elastic modulus value so that the natural period of vibration of the stringing is high enough to allow at least one half cycle of vibration to take place within the contact period of the ball. The success or otherwise of a particular string material in this regard may be determined by measuring the coefficient of restitution for a ball striking the string racket. In this test, a ball is dropped from a given height onto the racket which is clamped horizontally. The rebound height of the ball is measured, and the coefficient of restitution is defined as $$c=\sqrt{h_2/h_1}$$

where $h_1$=height from which the ball is dropped $h_2$=rebound height

Both heights are measured in the same units.

This test measures the amount of energy which is returned to the ball by the racket on impact. It is observed that synthetic strings of the prior art are inferior to natural gut when measured in this way, and this deficiency is experienced as a lack of power by the player when actually using the racket.

Another important property of a racket string is that the player should be able to "feel" the impact of the ball and judge the power of the return. It is believed that this is best achieved when the load-elongation characteristics of the string are substantially linear, or at least show no changes in direction of curvature over the working range. Again, prior art synthetic strings are inferior, many being not only non-linear in characteristics, but also showing S-shaped load-elongation curves.

A further requirement for a racket string is that the dynamic stiffness of the string should not increase substantially as the mean tension in the string increases. The dynamic stiffness, as hereinafter defined, is a measure of the response of the string to the impact of the ball. Many synthetic strings show a rapid increase in dynamic stiffness as the stringing tension is increased, so that a tightly strung racket, favoured by many players for good ball control, gives a harsh and "boardy" response when struck by the ball.

Yet a further requirement for a racket string is that it should not change in its elastic properties as the ambient temperature and humidity change.

A further deficiency of natural gut is that its playing life diminishes rapidly as the string diameter is reduced. Thin strings are desirable because the energy lost when the ball impacts on the strings is less for a racket strung with thin strings than for one strung with thicker, and therefore stiffer, strings. However, thin strings of natural gut have a very short life due to lack of abrasion resistance.

The object of the present invention is a sports racket string which has not only superior playing characteristics but also has excellent durability and uniform elastic characteristics.

We have found that the shape of the load-elongation curve of the string has an important effect on the playing properties, and that, surprisingly, the playing performance can be greatly increased by reducing the extensibility of the string at low levels of applied load.

According to one aspect of the present invention we provide a monofilament or multifilament sports racket string characterised in that it comprises or contains a synthetic thermoplastic aromatic polyetherketone material said string having an elongation not exceeding 5% when a tensile stress of at least 100 Newtons/mm$^2$ and preferably 120 Newtons/mm$^2$ is applied along the axis of the string and a dynamic stiffness, as herein defined, measured at a frequency in the range 150 to 300 Hz at a mean tensile stress of 175 Newtons/mm$^2$, of not greater than 1.150 times the dynamic stiffness measured at a mean tensile stress of 80 Newtons/mm$^2$.

Stress, in the context of present invention, is defined as the total axial load applied to the string divided by the total cross sectional area of the string. The dynamic stiffness may be measured using a method described by H. Tipton in Journal of the Textile Institute 1955, Vol. 46 page T322, suitably modified to accomodate the string of the invention.

Figure 2:
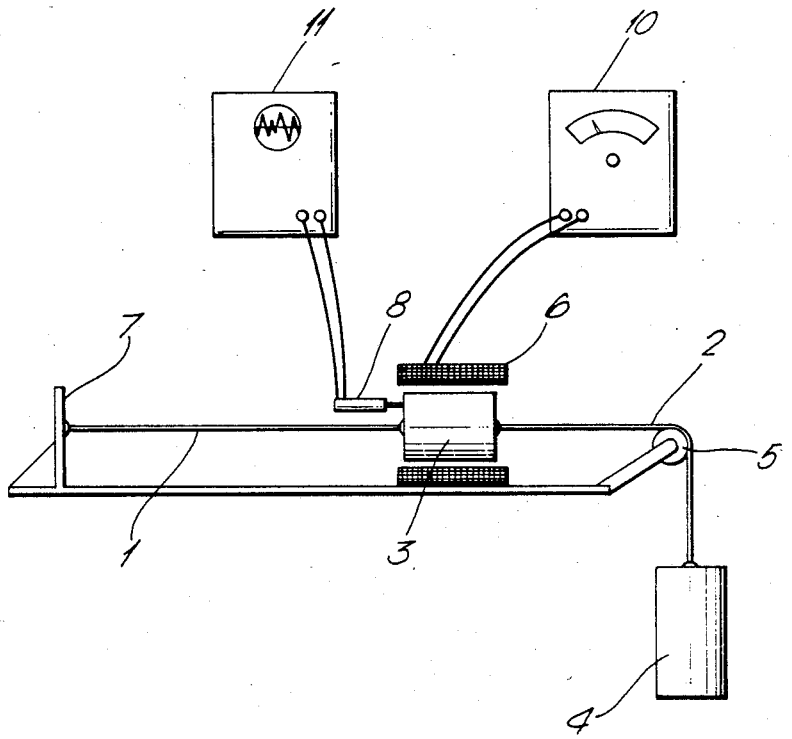
FIG. 2 is a schematic view of apparatus for measuring the dynamic stiffness of a sports racket string.

The modified apparatus is shown in FIG. 2 of the accompanying drawings. Two identical lengths of the string to be tested 1 and 2 are attached by suitable clamps to a freely suspended soft iron armature 3. The other end of string 1 is attached to a massive support 7, and the other string 2 is led over a freely rotating pulley 5 and attached to a tensioning weight 4. The tensioning weight can be varied as required to produce a stress in the strings of between 80 and 175 Newtons/mm$^2$.

The armature 3 is set into longitudinal vibration (ie vibration along the axis of the strings) by feeding alternating current from a suitable variable frequency current generator 10 to the coil 6 which surrounds the armature. The vibrations of the armature are detected by a gramophone pickup cartridge 8, the stylus of which is pressed lightly into contact with the armature. The electrical output from cartridge 8 is fed to an oscilloscope 11. The frequency of the alternating current generator 10 is adjusted until it coincides with the resonant frequency of the armature suspended on the tensioned strings 1, 2.

This is indicated by a maximum signal from the cartridge 8 as seen on the oscilloscope screen. This frequency F is then measured, either by means of a suitable meter built into the generator 10, or by observing the frequency of the signal on the screen of the oscilloscope.

The dynamic stiffness S is defined by the equation $$S=F^2 2\pi^2 LM$$

where

F=resonant frequency in Hertz

L=length of each string in meters

M=mass of armature in kg.

The values of L and M must be adjusted so that $150<F<300$ Hz.

For most racket strings of diameter 1.4 to 1.5 mm, suitable values are L=0.25 meters and M=0.035 kg.

The first measurement of S is made when the mean stress produced in the strings by the tensioning weight is 80 Newtons/mm$^2$. This is designated $S_{80}$. The tensioning weight is then increased to give a stress of 175 Newtons/mm$^2$ in the strings, and another determination of S is made designated $S_{175}$. For a string to have good playing performance in a racket it has been found that the ratio $S_{175}/S_{80}$ must not exceed 1.150.

A preferred feature of the racket string is that it possesses a load-elongation curve which is either substantially linear up to an elongation of at least 10% or, if curvature is shown, that the tangent modulus should nowhere increase as elongation increases.

The sports racket string of the invention is of a thermoplastic aromatic polyetherketone. Aromatic polyetherketones have the general formula —Ar—O— where Ar is an aromatic radical and at least some of the Ar radicals contain a ketone linkage. A preferred thermoplastic aromatic polyetherketone is polyetheretherketone ie. having the repeat unit —O—Ph—O—Ph—CO—Ph— where Ph is a p-phenylene. Such a polymer can readily be melt spun and drawn to form suitable monofilaments and multifilaments—see Research Disclosure Item 21602 dated April 1982.

According to another aspect, therefore, the present invention is concerned with a monofilament or multifilament sports racket string comprising or containing a thermoplastic aromatic polyetherketone and preferably polyetheretherketone.

Typically the mean overall diameter of the string lies in the range 0.5 mm to 2.0 mm.

When the string comprises multifilaments, then it may contain any number of individual filaments, for example of diameter from 0.01 mm to 1.5 mm, arranged together in any desirable manner. In particular the individual filaments may be glued together with a suitable adhesive to facilitate handling and stringing. However with this embodiment it is envisaged that the adhesive will not exceed 33% by weight of the string.

The individual filaments may also be held together by inserting them into a sheath of suitably flexible material, or by wrapping the bundle of filaments with another filament or filaments of the same or different material or by wrapping the bundle of filaments around a core comprising one or more filaments of the same or different material.

The invention may be illustrated by the following examples which exemplify, but shoud not be taken to limit, the invention.

EXAMPLE 1

A synthetic thermoplastic polymer, polyetheretherketone of intrinsic viscosity 1.0 measured at 25° C. in a solution of 0.1 g of the polymer in 100 ml of concentrated sulphuric acid, was melted at 370° C. and extruded at approximately 8 g/min through an orifice of 2 mm diameter to form a monofilament. The monofilament was cooled by blowing air over it at a velocity of 1 m/sec, and the solidified monofilament then passed round a pair of heated rolls rotating with a surface speed of about 2 m/min at a temperature of 180° C.

From these rolls, the filament was drawn off by a cold roll, with an imposed stretch ratio of 3:1, and finally wound up on a spool. The final diameter of the monofilament was 1.5 mm. The tensile properties of the monofilament are given in Table I, together with those of a comparable prior art synthetic racket string—OXITE—T. The monofilament was strung into a squash racket using a pulling tension of about 12 kg. The coefficient of restitution was measured in the manner described previously, with the results shown in Table II. The load-elongation curve of the string is plotted in FIG. 1. Playing tests showed that the racket performed excellently, with power and feel similar to that of natural gut, and markedly superior to other synthetic strings.

EXAMPLE 2

Polyetheretherketone of the same intrinsic viscosity as Example 1, was melted at 370° C. and extruded through a multi-orifice die containing 19 holes of 0.75 mm diameter. The total throughput was about 7 g/min, and the filaments were cooled to solidify them as described in Example 1. After passing over a hot roll rotating at 2 m/min and heated to a temperature of 180° C., they were stretched 2.75 times and wound up on a spool at 5.5 m/min. The tensile results are given in Table I, and the coefficient of restitution in Table II. The load-elongation curve is plotted in FIG. 1. Playing tests showed that the string was greatly superior to conventional synthetic strings. The dynamic stiffness measured as previously described with L=0.25 meter and M=0.035 kg showed a ratio $S_{175}/S_{80}$ of 1.31.

EXAMPLE 3

Polyetheretherketone of the same intrinsic viscosity as in Example 1, was melted at 370° C. and extruded at approximately 16 gms/min through a 2 mm diameter orifice to form a monofilament. The monofilament was cooled and the solidified monofilament then passed round a pair of heated rolls rotating with a surface speed of 29 m/min at a temperature of 180° C.

From these rolls, the filament was drawn off by a cold roll with an imposed stretch ratio of 2.8, and finally wound up on a spool. The final diameter of the monofil was 0.44 mm.

Six identical monofils were then taken and wrapped evenly round a seventh monofil, made similarly to the others but with a final diameter of 0.47 mm, the number of wraps for each monofil being 90 per meter of the final assembly. The wrapped assembly was then passed at a tension of 6 kg for 40 seconds over a plate heater set at 200° C. to give a stable heat set assembly.

This assembly was subsequently passed through a melt extruder pressure cross head coating tap and die arrangement fed with a thermoplastic polyurethane with a hardness of 95 Shore A, tensile strength of 375 kg/cm$^2$, elongation of 450%, and 100% modulus of 75 kg/cm$^2$; 25% by weight of the final string being extruded as a sheathing round the monofil assembly. The sheathing was applied at a rate of 3 grams/minute, at a temperature of 230° C. from a die hole of 1.47 mm diameter. The product produced had a diameter of 1.47 mm, an extension at 120 N/mm$^2$ of 4.5% and a breaking extension of 24% and a dynamic stiffness ratio $S_{175}/S_{80}$ of 1.135.

The point P in FIG. 1 is the point defined by a stress of 120 N/mm$^2$ and an elongation of 5%. It can be seen that the load-elongation curves of strings of this invention pass to the left of this point and that they exhibit a tangent modulus which no where increases as elongation increases.

The prior art synthetics have curves which pass to the right of P, and show regions where the tangent modulus increases with increasing elongation.

TABLE I

| | Mean diameter mm | Extension at 120 N/mm$^2$ | Breaking Extension |
|---|---|---|---|
| Example 1 monofilament | 1.5 | 2.4% | 23% |
| Example 2 multifilament | 1.2 | 4.2% | 25% |
| Example 3 multifilament | 1.45 | 4.5% | 24% |
| Prior art synthetic OXITE-T | 1.4 | 9.1% | 30% |

TABLE II

| | Coefficient of Restitution |
|---|---|
| Example 1 monofilament | 0.682 |
| Example 2 multifilament | 0.682 |

TABLE II-continued

| | Coefficient of Restitution |
|---|---|
| Prior-art synthetic | 0.648 |

We claim:

1. A multifilament sports racket string comprising: a plurality of thermoplastic aromatic polyetheretherketone monofilaments, said string having an elongation not exceeding 5% when a tensile stress of 120 Newtons/mm$^2$ is applied along the axis of the string.

2. A multifilament sports racket string comprising: a plurality of polyetheretherketone monofilaments, said string having an elongation not exceeding 5% when a tensile stress of 100 Newtons/mm$^2$ is applied along the axis of the string and a dynamic stiffness, measured at a frequency in the range 150 to 300 Hz at a mean tensile stress of 175 Newtons/mm$^2$ of not greater than 1.150 times the dynamic stiffness measured at a mean tensile stress of 80 Newtons/mm$^2$.

3. A multifilament sports racket string as in claim 1 or 2 having an overall diameter in the range 0.5 mm to 2.0 mm.

4. A multifilament sports racket string as in claim 1 or 2 in which said plurality of monofilaments are glued together with an adhesive.

5. A multifilament sports racket string as in claim 4 wherein the adhesive does not exceed 33% by weight of the string.

6. A multifilament sports racket string as in claim 1 or 2 in which a bundle of said monofilaments is wrapped with another filament or filaments of a material which is the same as or different from the material of said monofilaments.

7. A multifilament sports racket string as in claim 1 or 2 formed by wrapping a bundle of said monofilaments around a core comprising at least one filament of a material which is the same as or different from the material of said monofilaments.

8. A sports racket string as in claim 1 or 2 formed by wrapping a bundle of said monofilaments around a core comprising one filament of the same material as said monofilaments, said core filament having a larger diameter than the diameter of the filaments in the bundle.

9. A sports racket string as in claim 1 or 2 provided with a sheath of flexible material.

10. A sports racket strung with a string comprising at least one thermoplastic aromatic polyetheretherketone monofilament.

11. A sports racket strung with a string comprising at least one thermoplastic aromatic polyetheretherketone monofilament, said string having an elongation not exceeding 5% when a tensile stress of 120 Newtons/mm$^2$ is applied along the axis of the string.

12. A sports racket strung with a string comprising at least one thermoplastic aromatic polyetheretherketone monofilament, said string having an elongation not exceeding 5% when a tensile stress of 100 Newtons/mm$^2$ is applied along the axis of the string and a dynamic stiffness, measured at a frequency in the range 150 to 300 Hz at a mean tensile stress of 175 Newtons/mm$^2$ of not greater than 1.150 times the dynamic stiffness measured at a mean tensile stress of 80 Newtons/mm$^2$.

13. A sports racket as in claim 10, 11 or 12 wherein the string has an overall diameter in the range 0.5 mm to 2.0 mm.

14. A sports racket as in claim 10, 11 or 12 in which said plurality of monofilaments are glued together with an adhesive.

15. A sports racket as in claim 14 wherein the adhesive does not exceed 33% by weight of the string.

16. A sports racket as in claim 10, 11 or 12 in which the string comprises a plurality of said monofilaments and in which a bundle of said monofilaments is wrapped with another filament or filaments of a material which is the same as or different from the material of said monofilaments.

17. A sports racket as in claim 10, 11 or 12 wherein the string comprises a bundle of said monofilaments wrapped around a core, which core comprises at least one filament of a material which is the same as or different from the material of said monofilaments.

18. A sports racket as in claim 10, 11 or 12 wherein the string comprises a bundle of said monofilaments wrapped around a core, which core comprises one filament of the same material as said monofilaments, said core filament having a larger diameter than the diameter of the filaments in the bundle.

19. A sports racket as in claim 10, 11 or 12 wherein the string is provided with a sheath of flexible material.

20. A sports racket as in claim 10, 11 or 12 wherein said string is a multifilament string comprising a plurality of monofilaments of thermoplastic aromatic polyetheretherketone.

21. A multifilament sports racket string comprising: a plurality of thermoplastic aromatic polyetherketone monofilaments, said string having an elongation not exceeding 5% when a tensile stress of 120 Newtons/mm$^2$ is applied along the axis of the string.

22. A multifilament sports racket string comprising: a plurality of polyetherketone monofilaments, said string having an elongation not exceeding 5% when a tensile stress of 100 Newtons/mm$^2$ is applied along the axis of the string and a dynamic stiffness, measured at a frequency in the range 150 to 300 Hz at a mean tensile stress of 175 Newtons/mm$^2$ of not greater than 1.150 times the dynamic stiffness measured at a mean tensile stress of 80 Newtons/mm$^2$.

23. A multifilament sports racket string as in claim 21 or 22 having an overall diameter in the range 0.5 mm to 2.0 mm.

24. A multifilament sports racket string as in claim 21 or 22 in which said plurality of monofilaments are glued together with an adhesive.

25. A multifilament sports racket string as in claim 24 wherein the adhesive does not exceed 33% by weight of the string.

26. A multifilament sports racket string as in claim 21 or 22 in which a bundle of said monofilaments is wrapped with another filament or filaments of a material which is the same as or different from the material of said monofilaments.

27. A multifilament sports racket string as in claim 21 or 22 formed by wrapping a bundle of said monofilaments around a core comprising at least one filament of a material which is the same as or different from the material of said monofilaments.

28. A sports racket string as in claim 21 or 22 formed by wrapping a bundle of said monofilaments around a core comprising one filament of the same material as said monofilaments, said core filament having a larger diameter than the diameter of the filaments in the bundle.

29. A sports racket string as in claim 21 or 22 provided with a sheath of flexible material.

30. A sports racket strung with a string comprising at least one thermoplastic aromatic polyetherketone monofilament.

31. A sports racket strung with a string comprising at least one thermoplastic aromatic polyetherketone monofilament, said string having an elongation not exceeding 5% when a tensile stress of 120 Newtons/mm$^2$ is applied along the axis of the string.

32. A sports racket strung with a string comprising at least one thermoplastic aromatic polyetherketone, monofilament, said string having an elongation not exceeding 5% when a tensile stress of 100 Newtons/mm$^2$ is applied along the axis of the string and a dynamic stiffness, measured at a frequency in the range 150 to 300 Hz at a mean tensile stress of 175 Newtons/mm$^2$ of not greater than 1.150 times the dynamic stiffness measured at a mean tensile stress of 80 Newtons/mm$^2$.

33. A sports racket as in claim 30, 31 or 32 wherein the string has an overall diameter in the range 0.5 mm to 2.0 mm.

34. A sports racket as in claim 30, 31 or 32 in which said plurality of monofilaments are glued together with an adhesive.

35. A sports racket as in claim 34 wherein the adhesive does not exceed 33% by weight of the string.

36. A sports racket as in claim 30, 31 or 32 in which the string comprises a plurality of said monofilaments and in which a bundle of said monofilaments is wrapped with another filament or filaments of a material which is the same as or different from the material of said monofilaments.

37. A sports racket as in claim 30, 31 or 32 wherein the string comprises a bundle of said monofilaments wrapper around a core, which core comprises at least one filament of a material which is the same as or different from the material of said monofilaments.

38. A sports racket as in claim 30, 31 or 32 wherein the string comprises a bundle of said monofilaments wrapped around a core, which core comprises one filament of the same material as said monofilaments, said core filament having a larger diameter than the diameter of the filaments in the bundle.

39. A sports racket as in claim 30, 31 or 32 wherein the string is provided with a sheath of flexible material.

40. A sports racket as in claim 30, 31 or 32 wherein said string is a multifilament string comprising a plurality of monofilaments of thermoplastic aromatic polyetherketone.

* * * * *